US005921626A

United States Patent [19]

Baker

[11] Patent Number: 5,921,626

[45] Date of Patent: Jul. 13, 1999

[54] BLEACHER SEAT CUSHION

[76] Inventor: Stephen A. Baker, 8052 Eastdale Dr., Cincinnatti, Ohio 45255

[21] Appl. No.: 08/996,562

[22] Filed: Dec. 23, 1997

[51] Int. Cl.[6] ..... A47C 27/00

[52] U.S. Cl. ..... 297/219.1; 5/653; 297/252

[58] Field of Search ..... 5/653, 654, 655.9; 297/219.1, 250.1, 252, 411.23; 108/90

[56] References Cited

U.S. PATENT DOCUMENTS

| | | | |
|---|---|---|---|
| 2,545,840 | 3/1951 | Browne . | |
| 2,689,602 | 9/1954 | Morgan . | |
| 2,715,434 | 8/1955 | Lukens . | |
| 2,717,633 | 9/1955 | Hartmann . | |
| 2,865,433 | 12/1958 | Warner | 5/653 |
| 2,993,675 | 9/1961 | Tatter . | |
| 3,113,325 | 12/1963 | Kamp | 5/17 |
| 3,222,694 | 12/1965 | Schick | 5/653 |
| 4,079,993 | 3/1978 | Pierce . | |
| 4,212,496 | 7/1980 | Kirkham, Jr. . | |
| 4,729,599 | 3/1988 | Nissen | 297/219.1 |
| 4,925,241 | 5/1990 | Geraci | 297/229 |
| 5,070,664 | 12/1991 | Groh et al. | 297/218 |
| 5,368,360 | 11/1994 | Groh | 5/219.1 |
| 5,375,552 | 12/1994 | Scott | 5/654 |
| 5,505,517 | 4/1996 | Groh et al. | 297/219.1 |
| 5,513,896 | 5/1996 | Groh et al. | 5/219.1 |
| 5,533,219 | 7/1996 | Meyers | 5/653 |

*Primary Examiner*—Alex Grosz
*Attorney, Agent, or Firm*—Pearne, Gordon, McCoy & Granger LLP

[57] ABSTRACT

A portable seat cushion for a bleacher seat includes a polyethylene foam extrusion having a generally planar top portion, front and rear portions downwardly extending from front and rear edges of the top portions, and bottom portions inwardly extending from lower ends of the front and rear portions. The top, front, rear, and bottom portions form a channel-shaped cross-section having a central passage sized for the bleacher seat to pass therethrough. The bottom portions are sized to form an opening for insertion of the bleacher seat into the central passage, upon flexure of the top portion, and to retain the bleacher seat within the central passage.

20 Claims, 3 Drawing Sheets

BLEACHER SEAT CUSHION

BACKGROUND OF THE INVENTION

The present invention generally relates to seat cushions and, more particularly, to portable seat cushions for bleacher seats.

Bleacher seats or stadium benches are commonly found at outdoor and indoor sports arenas, fields, gymnasiums, swimming pools, and similar spectator facilities. The bleacher seats typically include beams of a hard material such as wood, aluminum, or rigid plastic for reasons of durability, maintenance, and cost. These hard materials, however, can cause discomfort to a viewer and detract from the viewer's enjoyment of the event, particularly, when these events last for several hours or more. This discomfort is especially a problem when no back rests are provided. Additionally, when the seats are made of aluminum, the seats conduct heat away from the spectator's body.

Many spectators attempt to alleviate this discomfort by sitting on various, blankets, pads, or cushions. The items however, easily fall to the ground, through the open bleacher, when the spectator stands or leaves the bleacher. This causes some spectators to tie or tape the items to the bleacher seats. Additionally, attempts have been made to design seat cushions specifically for stadium seats which are secured by various belts and buckles, tie-straps, levers, and such. See for example U.S. Pat. Nos. 2,545,840, 2,715,435, and 2,865,433. While these seat cushions may provide suitable cushioned support and may be secured to the seats, they are not easily and quickly attached and removed from the seats and are relatively expensive to manufacture.

Accordingly, there is a need in the art for a portable seat cushion which provides cushion-type support, is not easily pulled from the bleacher by movement of the user, insulates the user from the bleacher seat, is attachable to a bleacher seat, is easily securable and removable, does not require modification to the bleacher, is water resistant, is lightweight and easy to carry, and is inexpensive to produce or manufacture.

BRIEF SUMMARY OF THE INVENTION

The present invention provides a portable seat cushion for a bleacher seat which overcomes at least some of the above-noted problems of the related art. According to the present invention, a portable seat cushion includes a generally planar top portion, front and rear portions downwardly extending from front and rear edges of the top portions, and bottom portions inwardly extending from lower ends of the front and rear portions. The front and rear portions are generally perpendicular to the top portion and the bottom portions are generally perpendicular to the front and rear portions. The portable seat cushion is formed by at least one extrusion of a thermoplastic foam material. Preferably, the thermoplastic foam material is a polyethylene. According to another aspect of the present invention, the portable seat cushion is formed by first and second extrusions of a thermoplastic foam material which are secured together at a joint. The joint is preferably centrally located on the top portion between the front and rear portions.

BRIEF DESCRIPTION OF THE SEVERAL VIEWS OF THE DRAWING

These and further features of the present invention will be apparent with reference to the following description and drawings, wherein.

DETAILED DESCRIPTION OF PREFERRED EMBODIMENT

Figure 1:
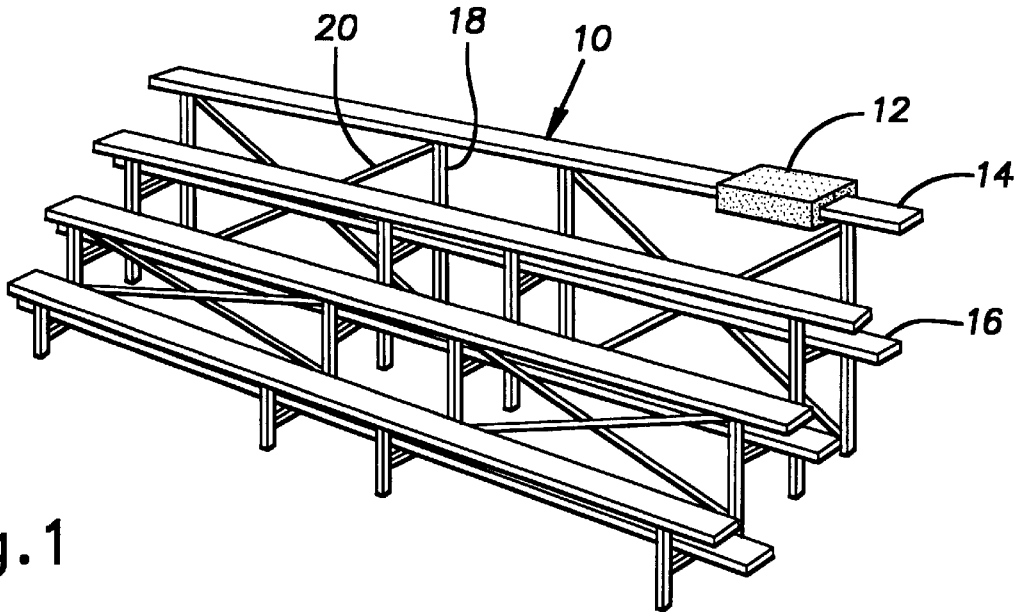
FIG. 1 is a perspective view of a bleacher seat having a portable seat cushion temporarily secured thereto according to the present invention.
Figure 2:
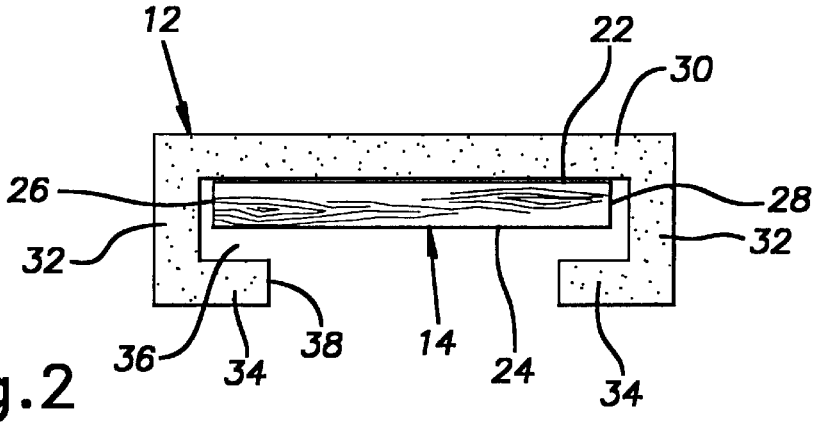
FIG. 2 is an enlarged elevational view of the end of the bleacher seat and seat cushion of FIG. 1.

FIGS. 1 and 2 illustrate a bleacher 10 having a portable seat cushion 12 temporarily secured thereto according to the present invention. The illustrated bleacher 10 includes a plurality of elongated beams or seats 14 and a plurality of elongated foot rests 16 each mounted on vertical struts 18 and cross ties 20. Each seat 14 has generally horizontal and spaced-apart upper and lower surfaces 22, 24 and generally vertical and spaced apart front and rear surfaces 26, 28. While the illustrated seats 14 are wood planks, the portable seat cushion 12 works equally well with other types of bleacher seats such as, for example, plastic or aluminum extrusions and wood planks capped with plastic extrusions.

Figure 4:
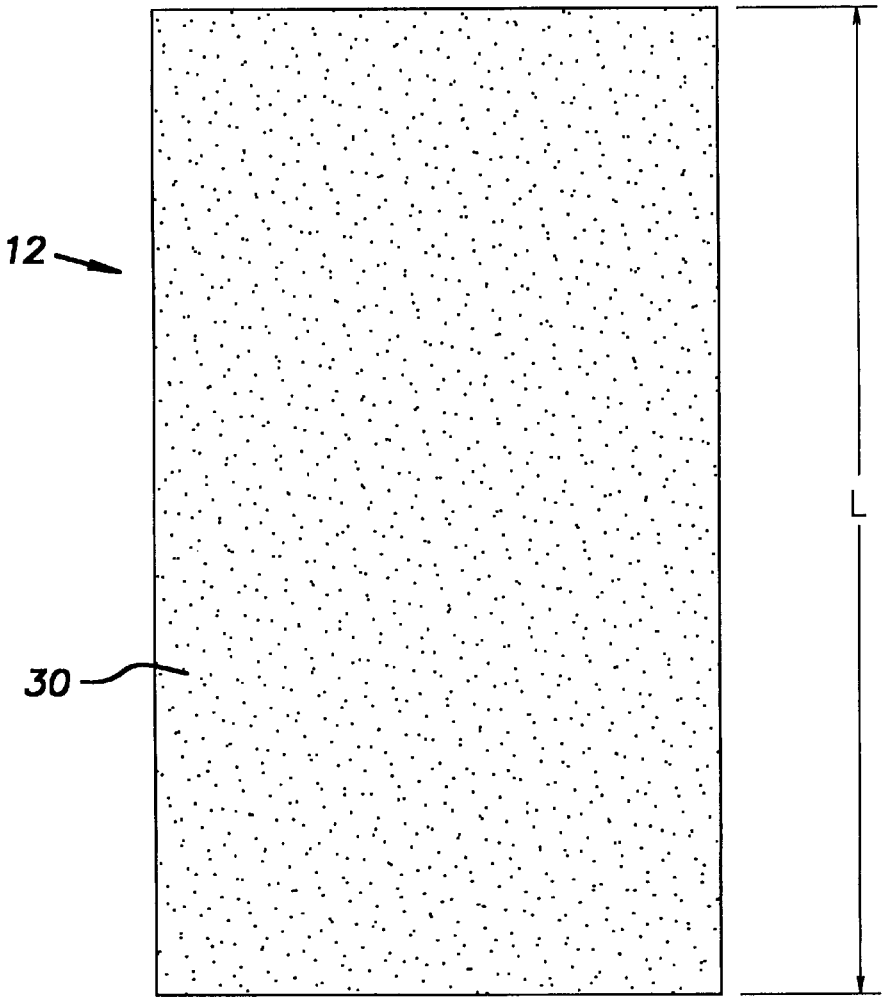
FIG. 4 is a plan view of the portable seat cushion of FIG. 1.
Figure 5:
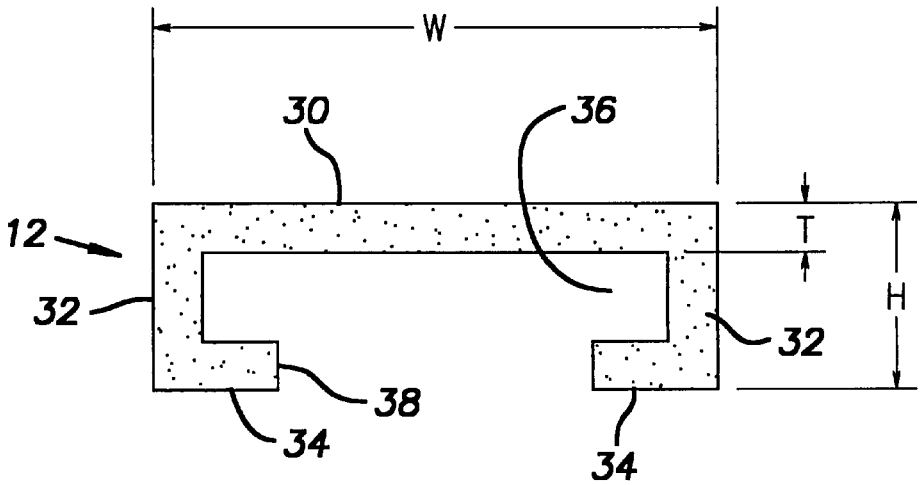
FIG. 5 is an elevational view of the portable seat cushion of FIG. 4.

As best shown in FIGS. 4 and 5, the portable seat cushion 12 is generally rectangular shaped when viewed from above and generally channel-shaped or downward facing C-shaped, when viewed in profile. The seat cushion 12 has a top or web portion 30, side or leg portions 32 integral with the top portion 30 and downwardly extending from front and rear edges of the top portion 30, and bottom or flange portions 34 integral with the side portions 32 and inwardly extending from the bottom of the side portions 32. The portions 30, 32, 34 are each generally straight, flat, or planar. The side portions 32 are substantially perpendicular to the top portion 30 and the bottom portions 34 are substantially perpendicular to side portions 32 so that the bottom portions 34 are generally parallel to and spaced apart from the top portion 30. It is noted that although the top, side and flange portions 30, 32, 34 are preferably joined at sharp corners, they can alternately be joined with other shapes such as, for example, rounded corners or beveled corners. It is also noted that although the seat cushion 12 is preferably rectangularly shaped, it can alternately have other forms such as, for example, rounded or beveled corners.

The top, side, and bottom portions 30, 32, 34 form a rectangularly-shaped central cavity or passage 36 which extends through the length of the seat cushion 12 and is open at each end of the seat cushion 32. The central passage 36 is sized and shaped for receiving one of the bleacher seats 14 therein so that the bleacher seat 14 passes through the seat cushion 12 as described in more detail hereinbelow. The inner ends of the bottom portions 34 are spaced apart to form an opening 38 therebetween which opens into the central passage 36. The opening 38 is sized and shaped for inserting one of the bleacher seats 14 therethrough as described in more detail hereinbelow.

The seat cushion 12 preferably has a length L which is sized for a single spectator to sit comfortably thereon. The length L is preferably in the range from about 16 inches to about 24 inches, and more preferably about 18 to about 20 inches. The wall thickness T of the cushion top portion 30 is sized to provide both cushioned support for the spectator during use and flexible bending during installation and removal. The thickness T is preferably in the range from about 0.75 inches to about 1.5 inches, and more preferably about 1 inch. Preferably, the wall thickness of the side and bottom portions 32, 34 is generally equal to the thickness T of the top portion 30.

The central passage 36 preferably has a width and height sized to receive a variety of different sized bleacher seats 14. The passage 36 preferably has a width in the range of about 8 inches to about 11 inches, and more preferably about 9½ inches. The passage 36 preferably has a height in the range of about 1 inch to about 2 inches, and more preferably about 1⅝ inches.

The opening 38 preferably has a width sized to allow a variety of different sized bleacher seats 14 to pass therethrough when the cushion top portion 30 is flexed and to capture the variety of different sized bleacher seats 14 within the passage 36. The opening 38 preferably has a width in the range of about 8 inches to about 11 inches, and more preferably about 6½ inches.

A seat cushion 12 particularly well suited to fit on several of the most common bleacher seats 14 has an overall length L of about 20 inches, an overall height H of about 3¾ inches, an overall width of about 11½ inches, and a nominal thickness of about 1 inch. Therefore, the length L is preferably about 1.75 times larger than the width and the width W is preferably about 3 times larger than the height H. Furthermore, the passage 36 has a width of about 9½ inches and a height of about 1⅝ inches and the opening 38 has a width of about 6½ inches.

The seat cushion 12 is formed from a light weight and resilient foam material which is suitably compressible to provide cushioning support for the spectator. The foam material is light weight so that the seat cushion 12 is relatively easy to transport to the spectator facility. The foam material is resilient so that the flexure of installation and removal and the weight of the spectator does not cause permanent deformation. The foam material preferably has a density in the range of about 1.7 to 2.5 lbs./cubic foot and more preferably has a density of about 2 to about 2.2 lbs./cubic foot. The foam material is preferably a thermoplastic foam such as, for example, cross-linked polyethylene foam. The foam material is preferably a closed cell foam material so that it is generally weather proof, that is, water resistant. Because the foam material is itself weather resistant no separate outer covering or protector is required.

The seat cushion 12 is preferably formed by a foam extrusion process. A foam slab is extruded and then cut into elongate blocks having a rectangular-shaped cross-section with the desired height H and width W of the seat cushion 12. The central passage 36 is then cut by any suitable means such as, for example, milling. Finally, the seat cushions 12 are formed by cutting to the desired length L.

Figure 6:
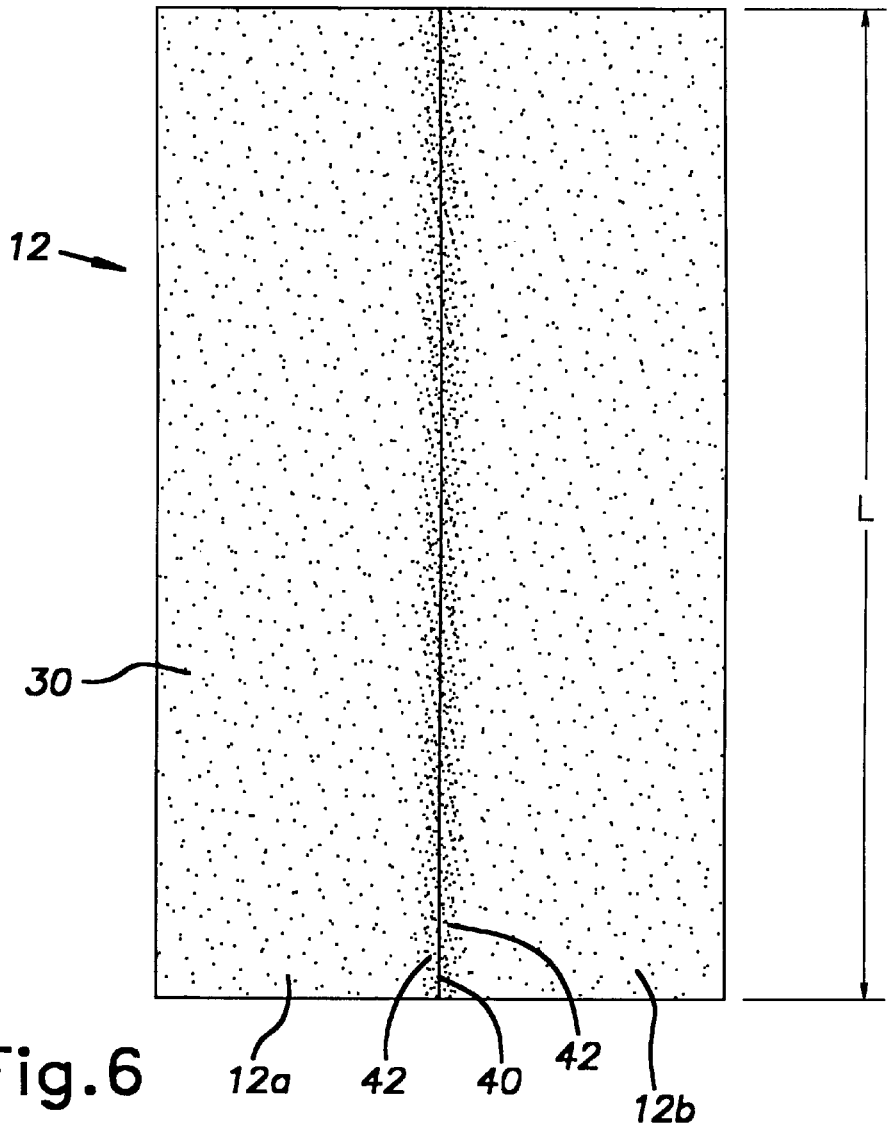
FIG. 6 is a plan view of a variation the portable seat cushion according to the present invention.
Figure 7:
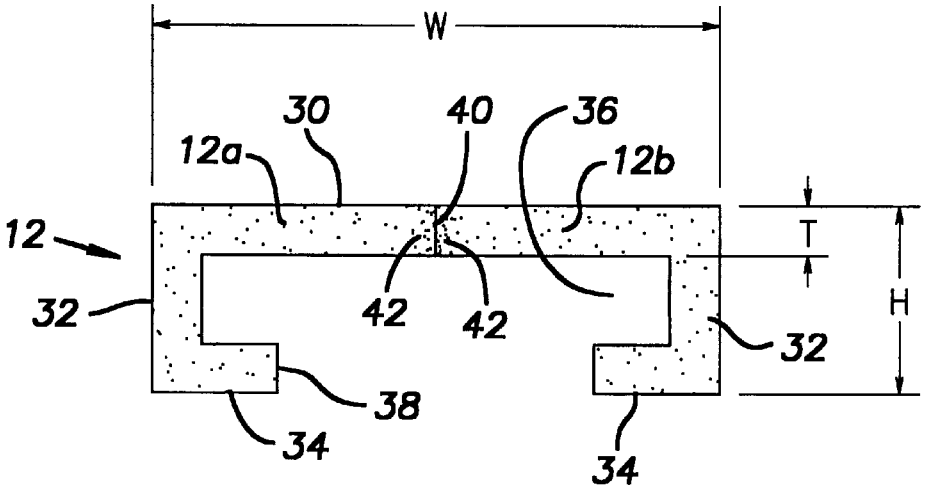
FIG. 7 is an elevational view of the portable seat cushion of FIG. 6.

Alternatively, the above-described profile of the seat cushion 12 can formed by a foam extrusion. As best shown in FIGS. 5 and 6, however, at least two extrusions 12*a*, 12*b* are preferably formed and joined together to obtain the above-described profile. Multiple extrusions 12*a*, 12*b* are preferred so that the extrusions 12*a*, 12*b* are of a sized which can be formed by common foam extruders. The illustrated embodiment has two extrusions 12*a*, 12*b* which are generally J-shaped and are identical in cross-section. The extrusions 12*a*, 12*b* are joined at the tops thereof with the extrusions facing each other (as best shown in FIG. 7).

Joined in this manner, a longitudinally extending joint 40 is formed generally at the center of the top portion 30 of the seat cushion 12. It is noted that the extrusions 12*a*, 12*b* could alternatively have other shapes which would result in a joint 40 at other locations. It is also noted that the seat cushion 12 could be formed by more than two extrusions 12*a*, 12*b* such as, for example two C-shaped extrusions and a straight extrusion forming two parallel and spaced apart joints. It is preferable, however, for the extrusions 12*a*, 12*b* to have the illustrated shape so that the extrusions 12*a*, 12*b* have identical cross-sections and the joint 40 is generally at the center of the top portion 30 which sees the highest flexure stress during installation and removal.

The two extrusions 12*a*, 12*b* are preferably fused, that is heat welded, together. Once the two extrusions 12*a*, 12*b* are formed by foam extrusion machines, the extrusions 12*a*, 12*b* are held in opposed relation to one another with a heating plate therebetween between. The heating plate is heated to a uniform temperature which is higher than the melting point temperature of the foam material of the extrusions 12*a*, 12*b*. The extrusions 12*a*, 12*b* are urged toward the heating plate so that the surfaces to be joined are urged toward the heating plate to uniformly heat and melt the surfaces to be joined. The molten confronting surfaces are then quickly abutted together under pressure and fused together. Once the molten material has cooled, the joint 40 is formed which securely joins the extrusions 12*a*, 12*b*. Additionally, areas or zones 42 of increased density are formed adjacent the joint 40. These zones 42 of increased density provide the joint 40 with higher strength than the generally low density foam material of the remainder of the extrusions 12*a*, 12*b*.

The foam material of the seat cushion 12 can have a variety of colors which can be utilized to display a particular sporting team or school color. It may also be desirable to form the different extrusions 12*a*, 12*b* with foam material having different colors. Additionally, the outer surfaces of the seat cushion 12 can be provided with a variety of colorful imprints such as lettering or graphical displays so that a particular sporting team or school insignia, logo, and/or name can be displayed. These imprints may be in single or multiple colors, and conventional silkscreening may be utilized to apply the imprints. Alternatively, these imprints may be applied with decals or adhesive-backed labels.

Figure 3:
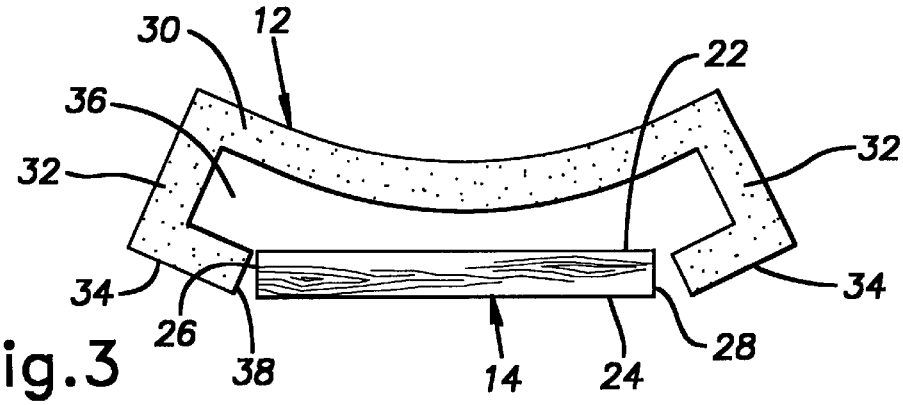
FIG. 3 is a an elevational view similar to FIG. 2 but showing the seat cushion during installation or removal.

As best shown in FIG. 3, the seat cushion 12 is installed on the bleacher seat 14 by flexing or deforming it from its original shape. The spectator centrally grasps the seat cushion 12 with one hand located at the front edge of the top portion 30 and one hand located at the rear edge of the top portion 30. The spectator then applies a bending force which deforms or bends the top panel 30 about its central longitudinal axis as illustrated in FIG. 3. Note that he increased density zones 42 can act to reenforce the portion of the seat cushion 12 which is bent in a hinge-like manner. The top portion 30 is deformed or bent an amount adequate to enlarge the opening 38 to accept the bleacher seat 14 therethrough. Once the opening 38 is enlarged to an adequate size, the spectator lowers the seat cushion 12 over the bleacher seat 14 so that the bleacher seat 14 passes through the opening 38 and into the central passage 36. Once the top portion 30 of the seat cushion 12 engages the upper surface 22 of the bleacher seat 12, the spectator releases the seat cushion 12. Once released, the seat cushion 12 resiliently springs back to its original undeformed shape. The foam material of the seat cushion 12, therefore, is sufficiently flexible so that it may be flexed from its original shape to a tensed shape and sufficiently resilient to return to its original shaped from the tensed shape upon release.

As best shown in FIG. 2, the bleacher seat 14 passes through the seat cushion 12 within the central passage 36. The top, side and flange portions 30, 32, 34 are adapted and configured to generally surround the upper, front, and rear surfaces 22, 26, 28 of the bleacher seat 14. Additionally, the cushion bottom portions 34 are adapted and configured to inwardly extend below the edges of the lower surface 24 of the bleacher seat 14. Positioned in this manner, the side portions 32 limit forward and rearward movement of the seat cushion 12 relative to the bleacher seat 14 and the bottom portions 34 limit upward movement of the seat cushion 12 relative to the bleacher seat 14. In this installed position, the flexible bottom portions 34 retain the seat cushion 12 on the bleacher seat 14. Therefore, the seat cushion 12 is removably secured to the bleacher seat 14 to prevent accidental removal due to incidental movement of the spectator or those spectators located around the spectator. The seat cushion 12 also can be easily removed when desired by reversing the above described installation procedure.

The seat cushion 12 is preferably in it's original undeformed shape when positioned on the bleacher seat 14 as best shown in FIG. 2. Note that there may be gaps or spaces between the cushion side portions 32 and the seat front and rear surfaces 26, 28 and the cushion bottom portions 34 and the seat lower surface 24 due to the fact that the seat cushion 12 is preferably sized to fit on a variety of different sized bleacher seats 14. The bleacher seat 14, however, should not have a width smaller than the width of the cushion opening 38.

It can be seen from the above description that the portable seat cushion 12 according to the present invention provides cushion type support for a spectator which is attachable to the bleacher seat 14 so that it is not inadvertently pulled from the bleacher seat 14 by movement of the user. It can also be seen that the portable seat cushion 12 is lightweight and easy to handle, sized for one person, easily to install and remove, relatively inexpensive to produce, durable, highly insulating, and water resistant.

Although particular embodiments of the invention have been described in detail, it will be understood that the invention is not limited correspondingly in scope, but includes all changes and modifications coming within the spirit and terms of the claims appended hereto.

What is claimed is:

1. A portable seat cushion for temporary securement to a bleacher seat by a spectator, said portable seat cushion comprising a thermoplastic foam extrusion having a generally planar top portion, said top portion having a length in the range from about 16 inches to about 24 inches such that a single person can sit comfortably thereon, front and rear portions downwardly extending from front and rear edges of said top portion to limit forward and rearward movement of said seat cushion relative to the bleacher seat, said front and rear portions being generally perpendicular to said top portion, and bottom portions inwardly extending from lower ends of said front and rear portions to limit upward movement of said seat cushion relative to the bleacher seat, said bottom portions being generally perpendicular to said front and rear portions, said top, front, rear, and bottom portions forming a central passage sized for the bleacher seat to pass therethrough, said central passage having a width in the range of about 8 inches to about 11 inches and a height in the range of about 1 inch to about 2 inches, wherein said seat cushion is deformable for temporarily installing said seat cushion on the bleacher seat and is adapted to be loosely retained on the bleacher seat in an undeformed state.

2. The portable seat cushion according to claim 1, wherein said thermoplastic foam is a polyethylene foam.

3. The portable seat cushion according to claim 1, wherein said top portion has a length of about 20 inches.

4. The portable seat cushion according to claim 1, wherein said bottom portions are spaced apart to form an opening which opens into said central passage for insertion of the bleacher seat into said central passage.

5. The portable seat cushion according to claim 1, wherein said central passage has a width of about 9½ inches and has a height of about 1⅝ inches.

6. A portable seat cushion for a bleacher seat, said portable seat cushion comprising a thermoplastic foam extrusion having a generally planar top portion, front and rear portions downwardly extending from front and rear edges of said top portion, said front and rear portions being generally perpendicular to said top portion, and bottom portions inwardly extending from lower ends of said front and rear portions, said bottom portions being generally perpendicular to said front and rear portions, wherein said top, front, rear, and bottom portions form a central passage sized for the bleacher seat to pass therethrough and wherein said portable seat cushion is formed by first and second thermoplastic foam extrusions secured together at a joint.

7. The portable seat cushion according to claim 6, wherein said joint is centrally located on said top portion between said front and rear portions.

8. The portable seat according to claim 6 wherein said joint is a heat weld.

9. The portable seat cushion according to claim 6, wherein zones of higher density material are located adjacent said joint.

10. The portable seat cushion according to claim 6, wherein said thermoplastic foam has a density in the range of about 1.7 to about 2.5 pounds per cubic foot.

11. The portable seat cushion according to claim 6, wherein said thermoplastic foam has a density of about 2.0 to about 2.2 pounds per cubic foot.

12. A combination of a bleacher seat and a portable seat cushion temporarily secured thereto by a spectator, said combination comprising:

an elongate bleacher seat having generally horizontal upper and lower surfaces and a generally vertical front and rear surfaces joining the upper and lower surfaces to form a rectangular cross-section; and a seat cushion comprising a thermoplastic foam extrusion having a generally planar top portion extending over said upper surface, said top portion having a length in the range from about 16 inches to about 24 inches such that a single person can sit comfortably thereon, front and rear portions downwardly extending from front and rear edges of said top portion and covering said front and rear surfaces to limit forward and rearward movement of said seat cushion relative to said bleacher seat, said front and rear portions being generally perpendicular to said top portion, and bottom portions inwardly extending from lower ends of said front and rear portions below said lower surface to limit upward movement of said seat cushion relative to said bleacher seat, said bottom portions being generally perpendicular to said front and rear portions, said bleacher seat extending through a central passage formed by said top, front, rear, and bottom portions, said central passage having a width in the range of about 8 inches to about 11 inches and a height in the range of about 1 inch to about 2 inches, wherein said seat cushion is deformable for temporarily installing said seat cushion on said bleacher seat and is loosely retained on said bleacher seat in an undeformed state.

13. The portable seat cushion and bleacher seat according to claim 12, wherein said thermoplastic foam is a polyethylene foam.

14. The portable seat cushion and bleacher seat according to claim 12, wherein said portable seat cushion is formed by first and second thermoplastic foam extrusions secured together at a joint.

15. The portable seat cushion and bleacher seat according to claim 14, wherein said joint is a heat weld.

16. The portable seat cushion and bleacher seat according to claim 14, wherein said thermoplastic foam has a density of about 2.0 to about 2.2 pounds per cubic foot.

17. The portable seat cushion and bleacher seat according to claim 12, wherein said thermoplastic foam has a density in the range of about 1.7 to about 2.5 pounds per cubic foot.

18. The portable seat cushion and bleacher seat according to claim 12, wherein said top portion of said seat cushion has a length of about 20 inches.

19. The portable seat cushion and bleacher seat according to claim 12, wherein said central passage has a width of about 9½ inches and has a height of about 1⅝ inches.

20. A portable seat cushion for temporary securement to a bleacher seat by a spectator, said portable seat cushion comprising a polyethylene foam extrusion having a generally planar top portion, front and rear portions downwardly extending from front and rear edges of said top portion to limit forward and rearward movement of said seat cushion relative to the bleacher seat, said front and rear portions being generally perpendicular to said top portion, and bottom portions inwardly extending from lower ends of said front and rear portions to limit upward movement of said seat cushion relative to the bleacher seat, said bottom portions being generally perpendicular to said front and rear portions, said top, front, rear, and bottom portions forming a central passage sized for the bleacher seat to pass therethrough, said bottom portions being spaced apart to form an opening therebetween which opens into said central passage for insertion of the bleacher seat into said central passage, wherein said seat cushion has a length in the range from about 16 inches to about 24 inches such that a single person can sit comfortably thereon and said central passage has a width in the range of about 8 inches to about 11 inches and a height in the range of about 1 inch to about 2 inches, wherein said seat cushion is deformable for temporarily installing said seat cushion on the bleacher seat and is adapted to be loosely retained on the bleacher seat in an undeformed state.

* * * * *